US005201647A

United States Patent [19]

Niemiec et al.

[11] Patent Number: 5,201,647

[45] Date of Patent: Apr. 13, 1993

[54] ROTARY HYDRAULIC VANE DEVICE HAVING A SHAF SEAL

[75] Inventors: Albin J. Niemiec, Sterling Heights, Mich.; Louis J. Cardinale, Omaha, Nebr.

[73] Assignee: Vickers, Incorporated, Troy, Mich.

[21] Appl. No.: 780,621

[22] Filed: Oct. 23, 1991

[51] Int. Cl.[5] ..... F03C 2/22; F04C 2/344; F04C 15/00; F16J 15/24

[52] U.S. Cl. ..... 418/102; 418/104; 418/133; 277/9; 277/153

[58] Field of Search ..... 418/95, 102, 104, 133, 418/82, 267, 268; 277/9, 153

[56] References Cited

U.S. PATENT DOCUMENTS

| | | | |
|---|---|---|---|
| 2,836,441 | 5/1958 | Doble | 277/9 |
| 2,924,182 | 2/1960 | Blasutta et al. | 418/133 |
| 3,076,414 | 2/1963 | Adams | 418/133 |
| 3,272,138 | 9/1966 | Connoy et al. | 418/102 |
| 3,752,609 | 8/1973 | Niemiec et al. | 418/133 |
| 4,199,305 | 4/1980 | Pareja | 418/102 |
| 4,496,297 | 1/1985 | Ogawa | 418/133 |

FOREIGN PATENT DOCUMENTS

| | | | |
|---|---|---|---|
| 92814 | 12/1959 | Netherlands | 418/102 |
| 875950 | 8/1961 | United Kingdom | 418/102 |

*Primary Examiner*—John J. Vrablik

*Attorney, Agent, or Firm*—Barnes, Kisselle, Raisch, Choate, Whittemore & Hulbert

[57] ABSTRACT

A hydraulic fluid pressure energy translating device of the sliding vane type comprising a cartridge including a cam ring including an internal contour, a rotor having a plurality vanes rotatable therewith and slidable relative thereto in slots in the rotor with one end of each vane engaging the internal contour. The cartridge includes a rotor and has an internal contour cooperating to define one or more pumping chambers between the periphery of the rotor and the cam contour through which the vanes pass carrying fluid from an inlet port to an outlet port. Two pressure chambers are formed for each vane and each vane has two surfaces one in each chamber, both being effective under pressure in the respective chambers to urge the vanes into engagement with the cam. The cartridge further includes support plates. One of the support plates supports an annular shaft seal that engages a shaft rotatably mounted in the housing and supporting the rotor such that when the cartridge is removed from the housing, the shaft seal is simultaneously removed. The housing further includes a simple pressure relief valve positioned to regulate pressure on the other end of the housing into an area of lower fluid pressure.

6 Claims, 5 Drawing Sheets

ROTARY HYDRAULIC VANE DEVICE HAVING A SHAF SEAL

This invention relates to hydraulic fluid pressure energy translating devices such as pumps or motors.

BACKGROUND AND SUMMARY OF THE INVENTION

A form of pump and motor utilized in hydraulic power transmission comprises a rotor having a plurality of spaced radial vanes rotatable therewith and slidable relative thereto in slots provided in the rotor. The rotor and vanes cooperate with the internal contour of a cam to define one or more pumping chambers between the outer periphery of the rotor and the cam contour through which the vanes pass carrying fluid from an inlet port to an outlet port. Cheek plates are associated with each side of the cam and rotor through which the fluid flows to and from the rotating group. The passages and grooves in the cheek plates along with the cam contour define the pump cycles or zones, namely, fill (inlet), pre-compression transition (inlet to pressure), displacement (discharge) and decompression (discharge to inlet).

It has heretofore been recognized that it is essential for efficient operation of the pump to apply a biasing pressure to a chamber at the underside of the vanes in order to maintain them in contact with the cam. In the past pressure has been applied continuously or intermittently to the undersides of the vanes. In the continuous pressure arrangement, pressure is applied even when the vanes are in low pressure zones and has resulted in excessive cam and vane tip wear. In the intermittent pressure arrangement, pressure is applied to the vanes only when the vanes are in high pressure zones and only centrifugal force is utilized to urge the vanes toward the cam when the vanes are in low pressure zones.

It has heretofore been suggested and commercial devices have been made wherein additional pressure chambers are associated with each vane. The chamber at the base of each vane is commonly known as the under vane chamber and is subjected to cyclically changing pressure. The additional chambers are commonly known as the intra-vane chambers and are subjected to continuous high pressure. Typical devices are shown in U.S. Pat. Nos. 2,919,651, 2,967,488, 3,102,494, 3,103,893, 3,421,413, 3,447,477, 3,645,654, 3,752,609, 4,431,389 and 4,505,654. In such an arrangement, the contact of the vanes with the cam is controlled at all times by fluid pressure to the intra-vane and corresponding undervane chambers.

In such pressure energy translating devices, it is common to provide a shaft seal on the housing axially outwardly from the bearing that rotatably supports a shaft on which the rotor is mounted. When it is desired to replace the shaft seal, it is necessary to remove the pump from its installed position. This requires disconnecting the hydraulic lines and disconnecting the drive shaft.

Accordingly among the objectives of the present invention is to provide a hydraulic pressure energy translating device wherein the shaft seal may be readily removed and replaced; wherein the shaft seal can be pressurized even though the pump inlet is subjected to sub-atmospheric pressure and wherein in applications wherein the hydraulic fluid is a poor lubricant, the shaft bearing is protected from the hydraulic fluid.

In accordance with the invention, the hydraulic fluid pressure translating device comprises a cartridge including a cam ring including an internal contour, a rotor having a plurality vanes rotatable therewith and slidable relative thereto in slots in the rotor with one end of each vane engaging the internal contour. The cartridge includes a rotor and has an internal contour cooperating to define one or more pumping chambers between the periphery of the rotor and the cam contour through which the vanes pass carrying fluid from an inlet port to an outlet port. Two pressure chambers are formed for each vane and each vane has two surfaces one in each chamber, both being effective under pressure in the respective chambers to urge the vanes into engagement with the cam. The cartridge further includes support plates. One of the support plates supports an annular shaft seal that engages a shaft rotatably mounted in the housing and supporting the rotor such that when the cartridge is removed from the housing, the shaft seal is simultaneously removed. The housing further includes a simple pressure relief valve positioned to regulate pressure of the leakage prior to its passage to the pump inlet and the pressure acts upon the shaft seal to insure positive sealing regardless of the possible sub-atmospheric pressure at the pump inlet.

DESCRIPTION

Figure 1:
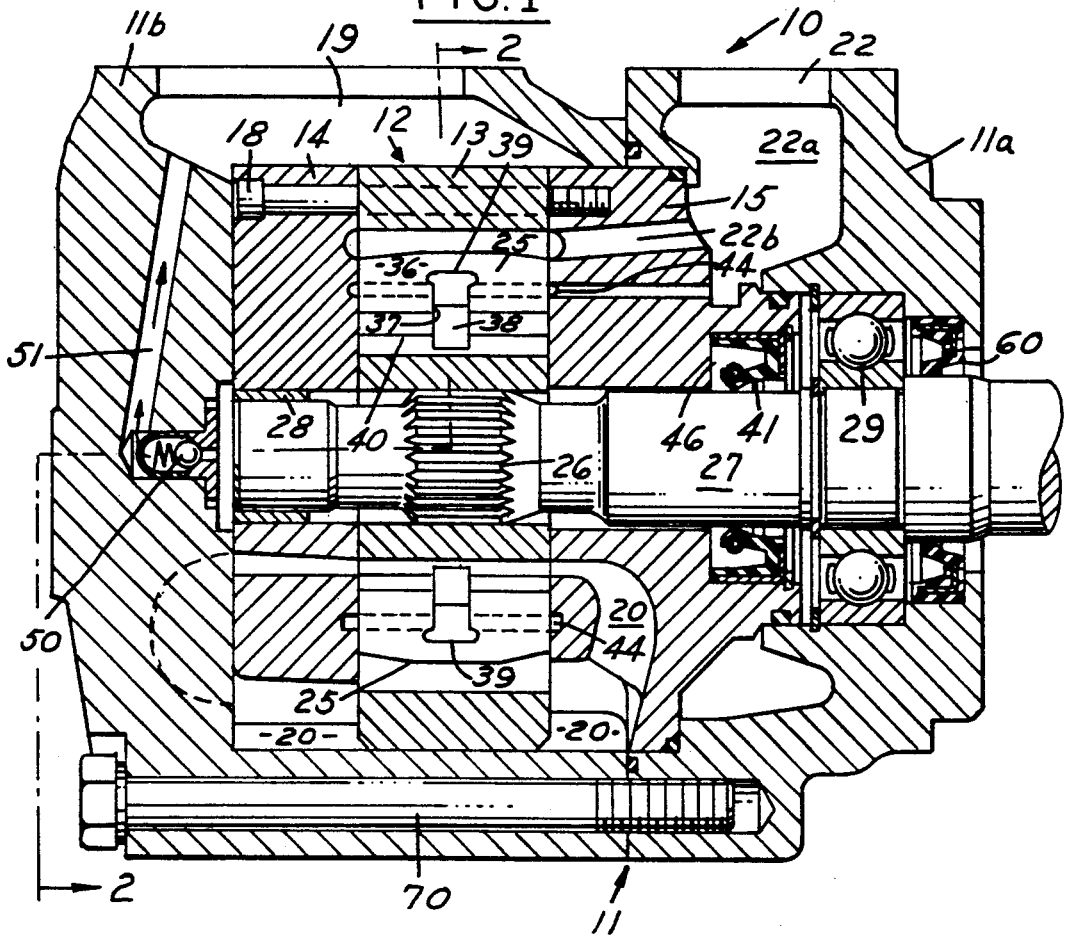
FIG. 1 is a longitudinal sectional view through a hydraulic pressure energy translating device embodying the invention.
Figure 2:
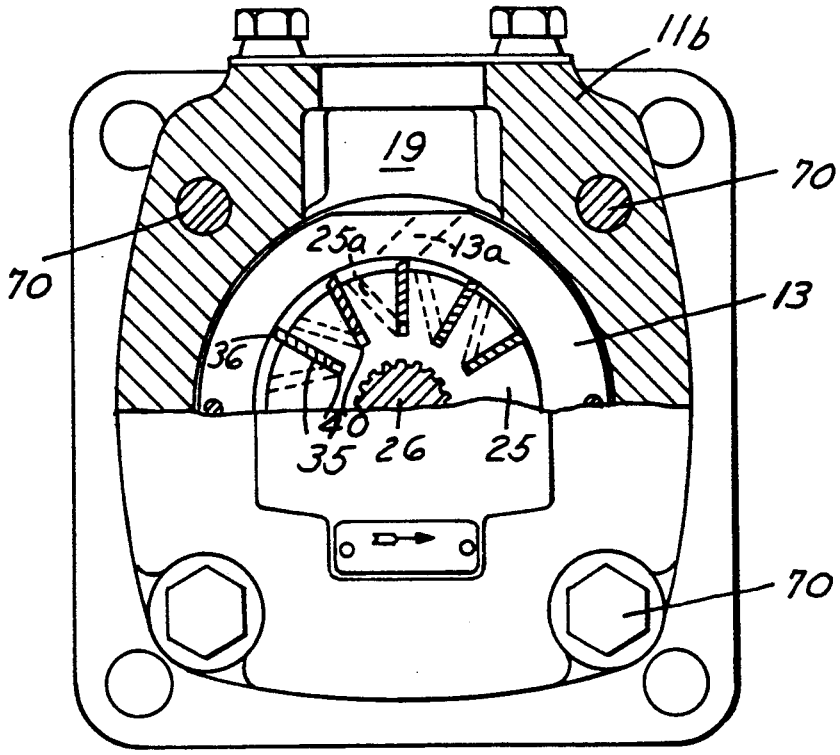
FIG. 2 is a part sectional view taken along the line 2—2 in FIG. 1.

Referring to FIGS. 1 and 2, there is shown a rotary sliding vane device or pump 10 comprising a housing 11 and a cartridge or subassembly 12. Housing 11 comprises a body **11*a* and a cover 11*b*. The cartridge 12 includes a cam ring 13 sandwiched between support plates 14, 15, all of which are secured to each other by bolts 18 extending through support plate 14 and cam ring 13 into threaded holes in support plate 15. The cover 11*b* is provided with an inlet supply connection port 19 leading into a pair of fluid port inlet openings 20 in the support plates 14 and 15. Inlet ports 13*a* located in ring 13** provide additional passages.

An outlet connection port 22 is provided in the body **11*a* which is directly connected by a passage 22*a* to a pressure delivery chamber 22*b* formed in support plate 15**.

A rotor 25 is rotatably mounted within the cam 13 on the splined portion 26 of a shaft 27 which is rotatably mounted with in a bearing 28 in the support plate 14 and a ball bearing 29 mounted with the body 11*a*. Housing body 11*a* and cover 11*b* are fastened together by bolts 70.

Cam ring 13 has an internal contour which is substantially oval in shape and which together with the periphery of the rotor 25 and the adjoining surfaces of the support plates 14, 15 define two opposed pumping chambers, each of which has fluid inlet, fluid transition, and fluid outlet zones. The fluid inlet zones comprise those portions of the pumping chambers (not shown) respectively, registering with the fluid inlet port openings 19. The fluid delivery zones comprise those portions of the pumping chambers registering, respectively, with opposed arcuately shaped fluid delivery port openings in support plates 14, 15 which are directly connected to the outlet connection port 22. Fluid flows to the inlet zones through inlet port openings 19 and passages in ring 13 through passages in the support plates 14, 15 and which permit the fluid to flow from the inlet 19 between the sides of cam ring 13.

The pumping device so far described is of the well known structure disclosed in the U.S. Pat. No. 2,967,488. It has been the practice in devices of this type to provide the rotor with a plurality of radial vane slots 35, each of which has a vane 36 slidably mounted therein. The outer end or vane tip of vanes 36 engage the inner contour of cam ring 13. The contour of cam ring 13 includes an inlet rise portion, an intermediate arcuate portion, an outlet fall portion, and another intermediate arcuate portion. The cam contour is symmetrical about its minor axis, thus each of the rise, fall and arcuate portions are duplicated in the other opposed portion of the contour. As the tips of vanes 36 carried by the rotor 25, and the vane tips traverse the outlet fall portions, the vanes 36 move radially inward. The spacing between each pair of vanes 36 is adapted to span the distance between each pair of ports in a manner to provide proper sealing between the inlet and outlet chambers of the pumping device.

Each vane 36 has a rectangular notch 37 extending from the inner end or base of the vane to substantially the mid-section thereof. A reaction member 38 comprises a flat sided blade substantially equal in width and thickness to that of the notch 37 in the vane so as to have a sliding fit within the vane and the side walls of each rotor vane slot 35. The side walls of the rotor vane slot 35, the vane 36 and the reaction member 38 define an expansible intra-vane chamber 39. An under vane pressure chamber 40 is defined by the base of each vane 36 and the base and side walls of each rotor vane slot 35. Chambers 40, 39 are separated by and sealed from each other by reaction member 38. Thus, the two chambers 40, 39 are provided substantially the same as shown in U.S. Pat. No. 2,967,488 which is incorporated herein by reference.

Referring to FIG. 2, the under vane chamber 40, associated with the base of each vane 36, is provided with fluid pressure by radial passage 25*a* in rotor 25. The radial passages transmit fluid to the under vane chambers 40 and, thus, to the bases of the vanes 36. Thus, the cyclically changing pressure which is exerted on the tips of the vanes 36 as they traverse the inlet and outlet portions of the ca contour is transmitted to the bases of the vanes 36.

Fluid under pressure is supplied to the chamber 39 by transverse slots in rotor 25 which communicate with arcuate grooves 44 in each face of each support plate 14, 15. Each groove extends about a portion of the travel of rotor 25. Grooves are provided in the displacement zones in concentric relation with the grooves for registry with the slots.

Figure 3:
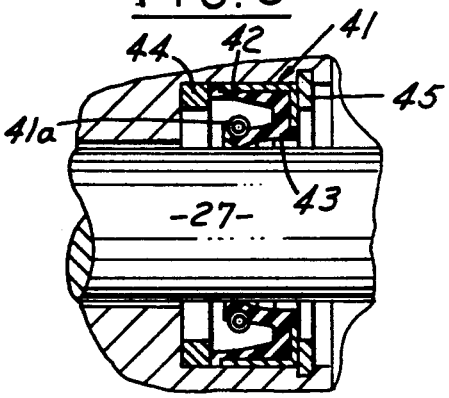
FIG. 3 is a fragmentary sectional view on an enlarged scale of the shaft seal portion of the device.
Figure 4:
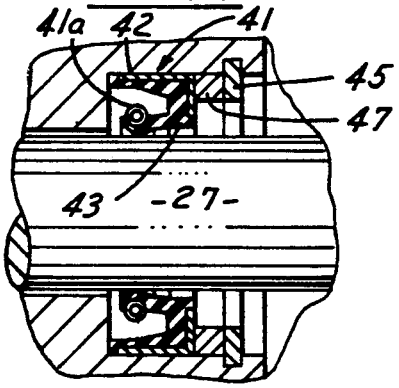
FIG. 4 is a fragmentary sectional view of a modified form of shaft seal.
Figure 7:
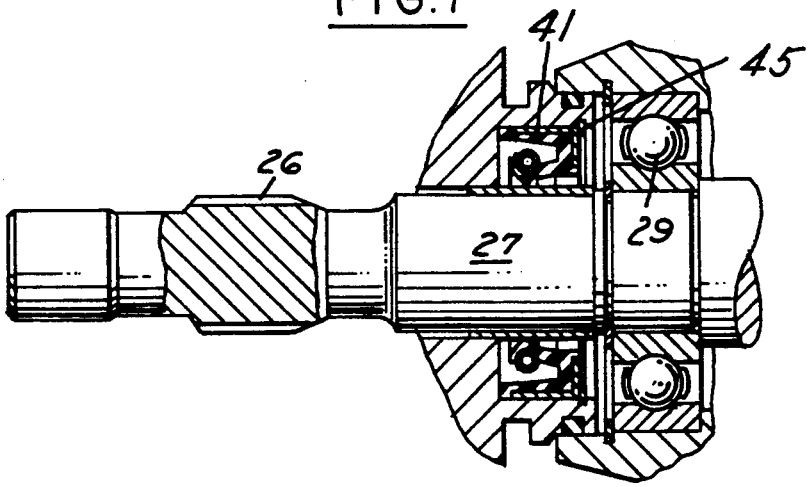
FIG. 7 is a fragmentary sectional view of a further modified shaft seal.
Figure 8:
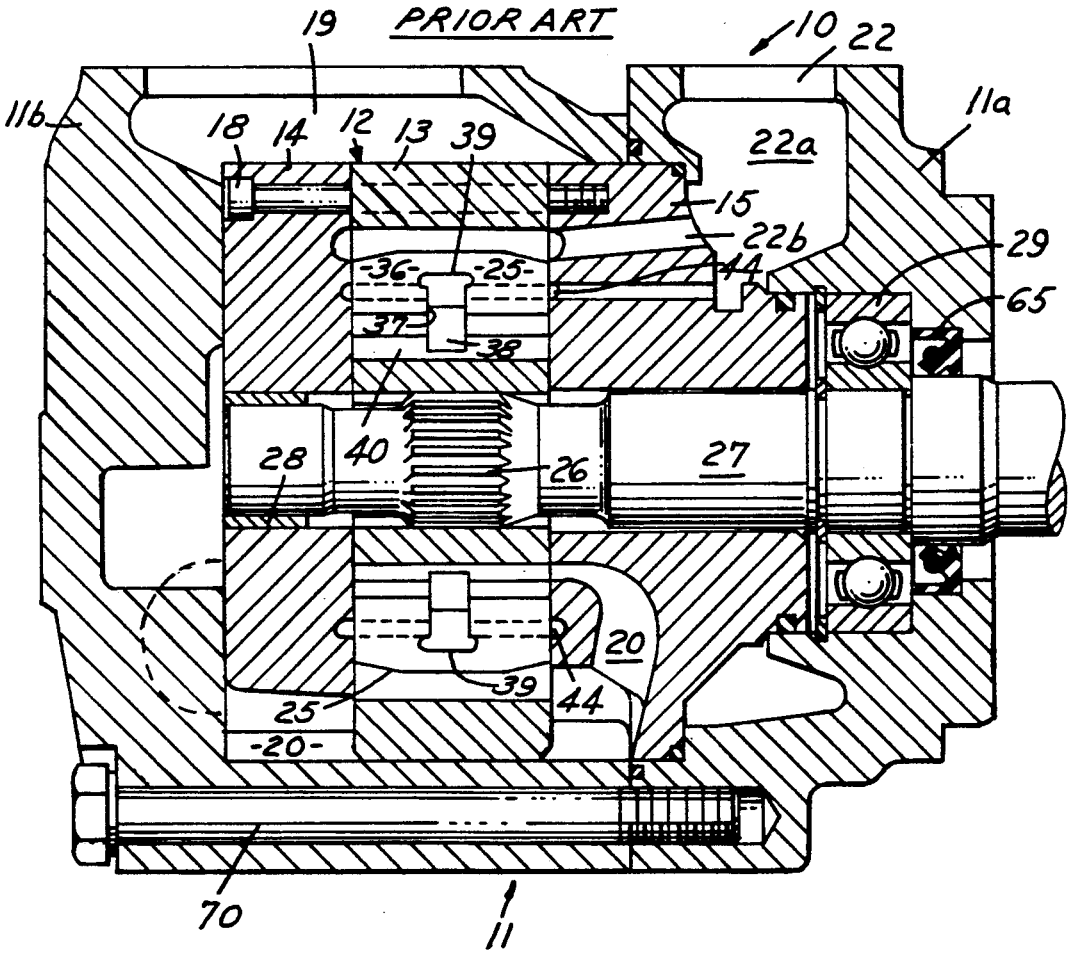
FIG. 8 PRIOR ART
FIG. 8 is a longitudinal sectional view of a prior art device.

In accordance with the invention as shown in FIG. 1, the support plate 15 is formed with an annular recess 46 in which a shaft seal 41 is positioned for engagement with the shaft 27 to provide a hydraulic seal. The shaft seal 41 is preferably U-shaped with the two flanges of the wing facing inwardly. Such shaft seals conventionally comprise a reinforcing metal portion 42, a U-shaped elastic seal 43 bonded thereto and a garter spring 41*a* which applies a radial force on the wing of the U-shaped member. In the form shown in FIG. 3, a spacer 44 is provided in an annular groove 46 for holding the shaft seal 41 in position. The spacer 44 permits the relocation of the sealing lip on the shaft seal 41. When the hydraulic device is serviced, the spacer can be changed or relocated to move the shaft seal 41 longitudinally of the shaft to accommodate a shaft wear groove that may have been formed by the shaft seal. In the form shown in FIG. 4, the spacer 47 is provided between the shaft seal and the snap ring 45. In the form shown in FIG. 7, the hydraulic seal 41 is dimensioned so that no spacer is required.

As shown in FIG. 1, the position of the shaft seal 41 is axially inwardly of the bearing 29 and in the cartridge assembly so that when the cover 11*b* and cartridge assembly 12 are removed, the seal is directly accessible in the cartridge assembly 12 and can be replaced.

As further shown in FIG. 1, a simple pressure relief valve 50 comprising a spring loaded ball is provided in a passage 51 that communicates with the inlet 19. In this manner the space between the shaft seal 41 and the pressure relief valve 50 is isolated permitting the normal leakage that may occur, as between the vanes and the support plates 14, 15 to pass axially into the space. When the pressure exceeds the predetermined amount, the hydraulic fluid will cause the valve 50 to open exhausting the fluid to the lower pressure.

Figure 5:
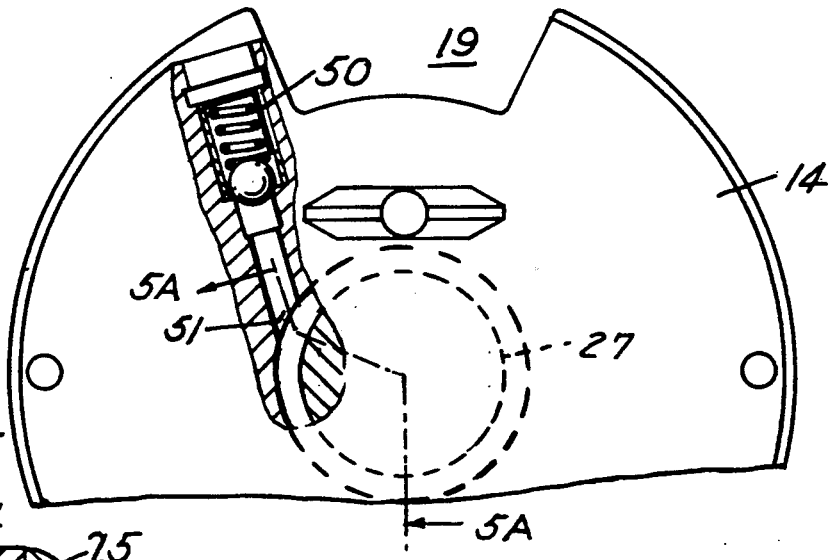
FIG. 5 is a part sectional view of a modified form of pressure relief valve system.
Figure 5A:
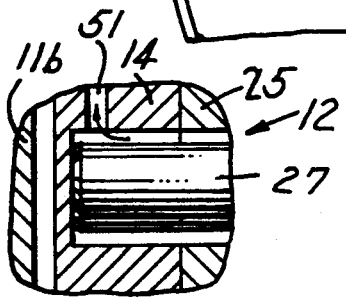
FIG. 5A is a fragmentary sectional view taken along the line 5A—5A in FIG. 5.

In the form shown in FIG. 5, the simple pressure relief valve 50 is positioned in a passage 51 locating within support plate 14 as shown in FIG. 5A. The cavity at the end of the shaft is closed so that leakage of hydraulic fluid is directed to the simple relief valve 50 and into the pump inlet 19.

Figure 6:
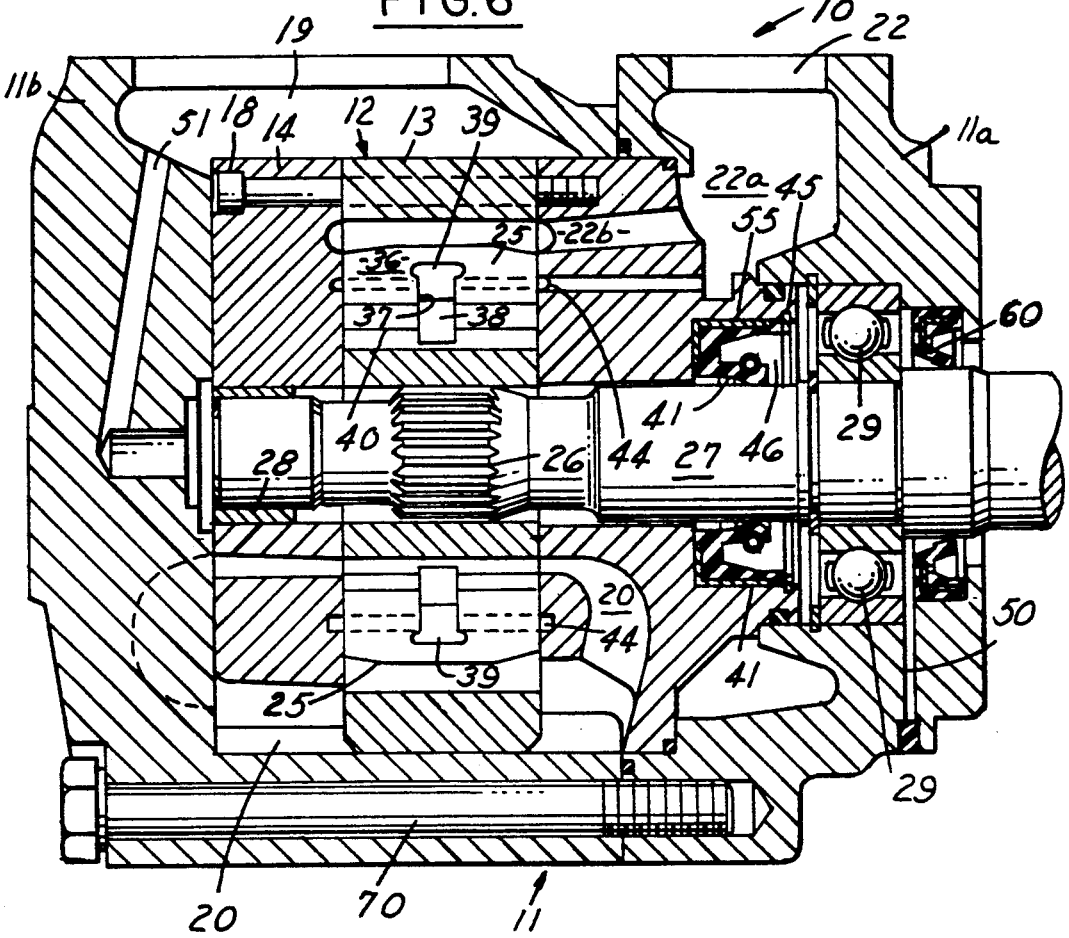
FIG. 6 is a longitudinal sectional view of a modified form of device.

In the form shown in FIG. 6, the device does not have a simple pressure relief valve and the shaft seal 55 is reversed so that a seal with the shaft 27 is maintained by the atmospheric pressure which is greater than the low pressure adjacent the shaft.

In each of the forms of the invention a wiper seal 60 is provided on the shaft in the body 11*a* to protect the bearing from dirt contamination or to force leakage from a shaft seal which may fail to exit in a path 50 for visual detection.

The construction may be contrasted to the prior art wherein a shaft seal 65 is provided in the body 11*a* axially outwardly of the bearing 29.

Figure 9:
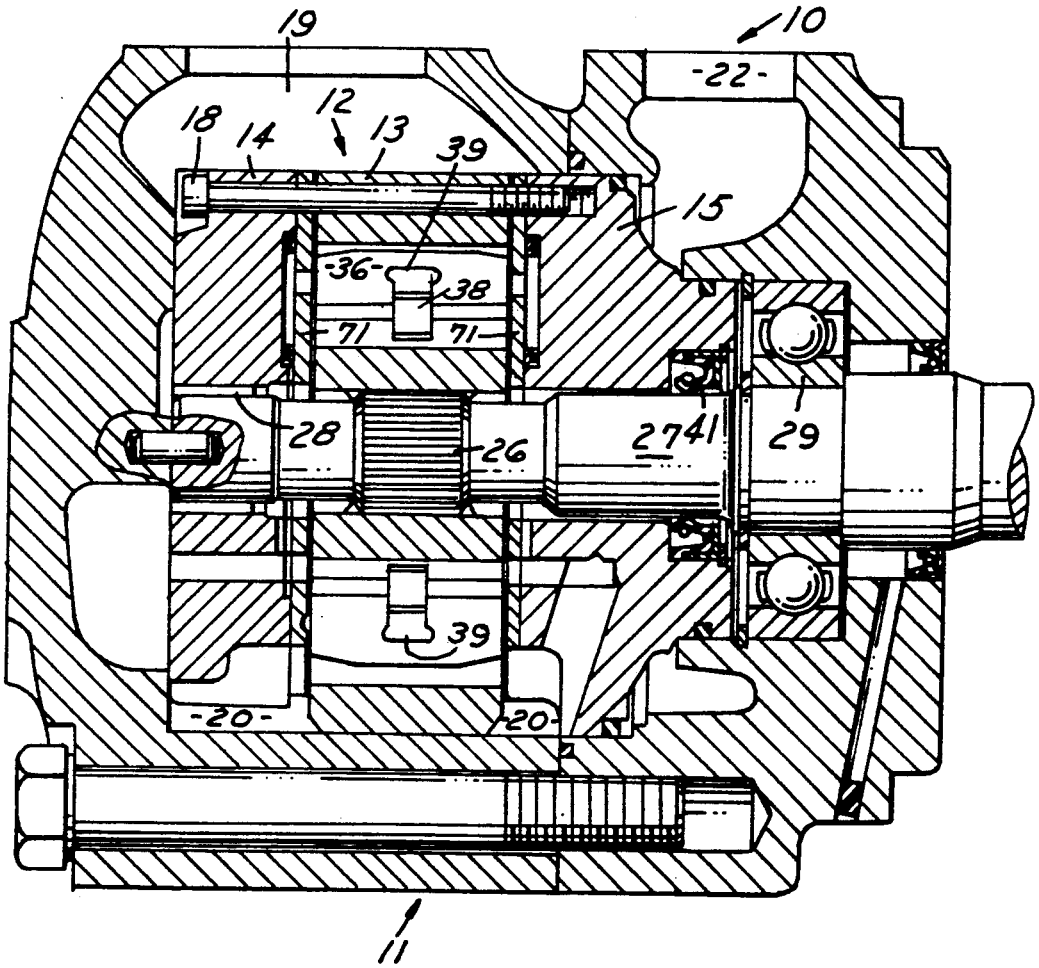
FIG. 9 is a longitudinal sectional view of a modified form of a device embodying the invention.

Referring to FIG. 9, the invention is also applicable to a hydraulic device utilizing flexible pressure plates 71 as shown, for example, in U.S. Pat. No. 3,752,609, incorporated herein by reference.

It can thus be seen that there has been provided a construction wherein:

1. The pump assembly permits servicing shaft seal without removing pump from installation disconnecting shaft coupling disconnecting hydraulic lines;

2. the pump assembly is provided with simple relief valve to control pressure of leakage into pump inlet. This feature will provide more positive and uniform sealing contact of the shaft seal on the shaft thus reducing external leakage experienced at shaft seals;

3. positive sealing to prevent air from being drawn into the pump when the pump inlet is at sub-atmospheric pressure, 4. the rolling contact bearing is isolated from hydraulic fluids that are poor lubricants such as water based fluids, water glycols etc.; and 5. the axial location of the shaft seal can be easily changed with a spacer to avoid shaft contact from previous assembly. (Shaft seal will groove into shaft surface).

Thus, the objectives are met of providing a hydraulic pressure energy translating device wherein the shaft seal may be readily removed and replaced; wherein the shaft seal can be pressurized even though the pump inlet is subjected to subatmospheric pressure and wherein in applications wherein the hydraulic fluid is a poor lubricant, the shaft bearing is protected from the hydraulic fluid.

We claim:

1. A hydraulic fluid pressure energy translating device comprising a housing, a cartridge assembly positioned in said housing, said cartridge assembly including a cam ring, a rotor having a plurality of vanes rotatable therewith and slidable in slots in the rotor with one end of each vane engaging the internal contour, a support plate on each side of said cam ring, and means securing said cam ring and support plates in assembled relation such that the cartridge assembly may be positioned in and removed from said housing as a unit, said housing including a body and a removable cover, a shaft extending through said body and one of said support plates and engaging said rotor, said one of said support plates including an annular recess adjacent said body, a shaft seal positioned and secured in said recess in said one support plate of said cartridge assembly and engaging said shaft, a shaft bearing in said body supporting one end of said shaft, said one support plate extending into and engaging said body, such that when the cover is removed, the cartridge assembly including said shaft seal can be removed such that the shaft seal is readily accessible for service.

2. The hydraulic fluid pressure energy translating device set forth in claim 1 including a simple pressure relief valve in said cover, said shaft having an end adjacent said valve and a passage in said cover extending from said valve to an area of lower pressure such that normal leakage between the vanes and the support plates passes into the space between the shaft seal and the pressure relief valve and when the pressure in said space exceeds a predetermined amount, the hydraulic fluid will cause the valve to open exhausting the fluid from said space to the lower pressure such that the pressure setting of the simple relief valve insures a positive sealing pressure on the shaft seal regardless of the inlet pressure.

3. The pressure energy translating device set forth in claim 1 including a pressure relief valve in said other support plate adjacent an area of lower pressure and a passage in said other support plate extending from the shaft such that normal leakage between the vanes and the support plates passes into the space between the shaft seal and the pressure relief valve and when the pressure in said space exceeds a predetermined amount, the hydraulic fluid will cause the valve to open exhausting the fluid from said space to the lower pressure such that the pressure setting of the simple relief valve insures a positive sealing pressure on the shaft seal regardless of the inlet pressure.

4. The pressure energy translating device set forth in claim 1 wherein the shaft seal is positioned such that atmospheric pressure assists in maintaining the shaft seal in sealing relationship with the shaft and a passage is provided in said cover extending from the end of said shaft to an area of lower pressure such that normal leakage between the vanes and the support plates into the space between the shaft seal and the space to said passage and the area of lower pressure.

5. The pressure energy translating device set forth in any one of claims 1–4 wherein the shaft seal comprises a U-shaped seal having radially spaced flexible portions which extend inwardly of the cartridge.

6. The pressure energy translating device set forth in any one of claims 1–4 wherein the shaft seal comprises a U-shaped seal having radially spaced flexible portions which extend outwardly of the cartridge.

* * * * *